US010467974B2

(12) United States Patent
Satoh

(10) Patent No.: US 10,467,974 B2
(45) Date of Patent: Nov. 5, 2019

(54) DISPLAY DRIVER AND METHOD FOR EVALUATING DISPLAY DEVICE

(71) Applicant: LAPIS Semiconductor Co., Ltd., Yokohama (JP)

(72) Inventor: Shinichi Satoh, Yokohama (JP)

(73) Assignee: LAPIS Semiconductor Co., Ltd., Yokohama (JP)

( * ) Notice: Subject to any disclaimer, the term of this patent is extended or adjusted under 35 U.S.C. 154(b) by 0 days.

(21) Appl. No.: 15/217,966

(22) Filed: Jul. 22, 2016

(65) Prior Publication Data

US 2017/0025081 A1 Jan. 26, 2017

(30) Foreign Application Priority Data

Jul. 24, 2015 (JP) ..... 2015-146859

(51) Int. Cl.
*G09G 3/00* (2006.01)
*G09G 3/3258* (2016.01)
*G09G 3/36* (2006.01)

(52) U.S. Cl.
CPC ..... *G09G 3/3648* (2013.01); *G09G 3/006* (2013.01); *G09G 3/3614* (2013.01); *G09G 3/3696* (2013.01); *G09G 2330/12* (2013.01)

(58) Field of Classification Search
CPC .. G09G 2330/12; G09G 3/006; G09G 3/3614; G09G 3/3648; G09G 3/3696
See application file for complete search history.

(56) References Cited

U.S. PATENT DOCUMENTS

2003/0201959 A1* 10/2003 Sakaguchi ..... G09G 3/3696 345/87
2008/0238905 A1* 10/2008 Matsui ..... G09G 3/006 345/205
2009/0322727 A1* 12/2009 Iwashimizu ..... G09G 3/3685 345/212
2013/0235023 A1* 9/2013 Chaji ..... G09G 3/3291 345/212

FOREIGN PATENT DOCUMENTS

JP 2012-220238 A 11/2012

OTHER PUBLICATIONS

Machine translated, JP2012-220238 (IDS document).*
Ishibashi et al., Machine translated JPH102937, Jan. 6, 1998. (Year: 1998).*

* cited by examiner

*Primary Examiner* — Sing-Wai Wu
(74) *Attorney, Agent, or Firm* — Rabin & Berdo, P.C.

(57) ABSTRACT

A display driver for driving a display panel includes a test control unit that generates n test data each designating a brightness gradation for each pixel of the panel, and controls a connected-state test for testing the display panel in a connected-state where the display panel and the display driver are electrically connected and a disconnected-state test for testing the display driver in a disconnected-state where the display panel and the display driver are electrically disconnected, a voltage converter that generates n pixel drive voltages from the n test data, an output unit that supplies each of the n pixel drive voltages to a corresponding data line in the connected-state, and a fault evaluator that outputs a test result signal including a fault or a no-fault in the connected-state and the disconnected-state by checking if each of the n pixel drive voltages is within an acceptable gradation voltage range.

15 Claims, 9 Drawing Sheets

FIG. 8

| TRS | | EVALUATION RESULT | |
|---|---|---|---|
| CONNECTED-STATE | DISCONNECTED-STATE | DATA DRIVER | DISPLAY PANEL |
| NO FAULT | NO FAULT | NO FAULT | NO FAULT |
| FAULT | NO FAULT | NO FAULT | FAULT |
| FAULT | FAULT | FAULT | UNKNOWN |

DISPLAY DRIVER AND METHOD FOR EVALUATING DISPLAY DEVICE

BACKGROUND OF THE INVENTION

Technical Field

The present invention relates to a display driver for driving a display device in accordance with an image signal.

Background Art

A liquid crystal display device, as an example of a display device, is provided with a liquid crystal display panel and a display driver for supplying, to the liquid crystal display panel, gradation voltages corresponding to the brightness levels of individual pixels, based on an image signal. As a pre-shipping test for this type of display driver, a gradation level test is carried out for testing whether or not each of the gradation voltages corresponding to the individual pixels in one horizontal scan line portion are, for each gradation, the voltage values corresponding to those gradations.

Here, in order to simplify the gradation level testing, a semiconductor device has been proposed (referencing Japanese Unexamined Patent Application Publication 2012-220238) wherein a testing circuit is provided within a display driver, wherein each gradation voltage corresponding to each pixel is derived selectively, and an evaluation as to whether or not the derived gradation voltage matches an ideal voltage, supplied from the outside, is performed, and the result of the evaluation is outputted to the outside. This testing circuit enables the detection, on the tester side, of faults (problems with the gradation voltage) that occur in the display driver, based on the evaluation results that are outputted from the semiconductor device to the outside.

SUMMARY OF THE INVENTION

However, preferably, in the pre-shipping testing of the liquid crystal display device, testing is carried out for faults in the display device as well, to eliminate defective parts prior to connecting the display driver and the display device.

However, as more channels are used and interconnection pitches become finer, testing of display devices independently has become difficult, and thus testing is carried out after connecting the display driver, which produces a problem in that it becomes impossible to identify which component is defective.

Given this, the object of the present invention is to provide a display driver wherein it is possible to identify a fault in the display device.

A display driver according to an aspect of the invention for driving a display panel having a plurality of data lines in which a plurality of pixels are arranged, the display driver includes n output lines each of which is connected to at least one of the plurality of data lines, n being an integer greater than 1, a test control unit configured to generate n test data each of which designates a brightness gradation for each pixel formed on a corresponding one of the plurality of data lines, respectively, and control a connected-state test for testing the display panel and a disconnected-state test for testing the display driver, the connected-state test being performed in a connected-state where the display panel and the display driver are electrically connected, the disconnected-state test being performed in a disconnected-state where the display panel and the display driver are electrically disconnected, a voltage converter configured to generate n pixel drive voltages for driving each pixel from the n test data, an output unit configured to supply each of the n pixel drive voltages to a corresponding one of the plurality of the data lines in the connected-state, and a fault evaluator configured to output a test result signal including a fault signal or a no-fault signal in the connected-state and the disconnected-state by checking a value of each of the n pixel drive voltages, the fault signal indicating at least one of the n pixel drive voltages is outside of the acceptable gradation voltage range, the no-fault signal indicating each of the n pixel drive voltages is within an acceptable gradation voltage range.

A method according to an aspect of the invention for evaluating a display device that includes a display panel having a plurality of data lines in which a plurality of pixels are arranged, and a display driver for driving the display panel, the method includes generating n test data each of which designates a brightness gradation for each pixel formed on a corresponding one of the plurality of data lines, n being an integer greater than 1, generating n pixel drive voltages to be supplied for each pixel from the n test data in a connected-state where the display panel and the display driver are electrically connected and in a disconnected-state where the display panel and the display driver are electrically disconnected, supplying each of the n pixel drive voltages to a corresponding one of the plurality of the data lines for testing the display panel in the connected-state, checking whether each of the n pixel drive voltages is within an acceptable gradation voltage range in the connected-state and in the disconnected-state, and outputting a test result signal including a fault signal or a no-fault signal in the connected-state and the disconnected-state, the fault signal indicating at least one of the n pixel drive voltages is outside of the acceptable gradation voltage range, the no-fault signal indicating each of the n pixel drive voltages is within an acceptable gradation voltage range.

In the present invention, the n ($1^{st}$ through $n^{th}$) pixel driving voltages, generated by the voltage converter based on the n pieces of test data that indicate the brightness gradations for testing, are supplied to the fault evaluator, and if the voltage values of the N pixel driving voltages are within the acceptable gradation voltage ranges, then a test result signal indicating that there is no fault is outputted, but if the voltage values are not within the acceptable gradation voltage ranges, then a test result signal indicating that there is a fault is outputted. Here the test control unit carries out a connected-state test for testing the display panel and a disconnected-state test for testing the display driver. The connected-state test is performed in a connected-state where the display panel and the display driver are electrically connected, and the disconnected-state test is performed in a disconnected-state where the display panel and the display driver are electrically disconnected.

Through this, if the test result signals obtained in both the connected-state test and the non-connected-state test are "no fault," it can be concluded that there is no fault in either the display driver or the display panel. If the test result signal obtained in the connected-state test indicates a "fault" and the test result signal obtained in the non-connected-state test indicates "no fault," it can be concluded that there is no fault in the display driver and that there is a fault in the display panel.

Consequently, the present invention enables the location of a fault to be identified easily through the ability to evaluate faults that occur on the driver and faults that occur on the panel separately, without disconnecting the display panel from the display driver.

BRIEF DESCRIPTION OF THE DRAWINGS

FIG. 8 is a diagram illustrating the correspondence relationship between test result signals TRS and the diagnostic results by the tester.

DETAILED DESCRIPTION OF THE INVENTION

Exemplary embodiments of the present invention will be explained in detail below, referencing the drawings.

Figure 1:
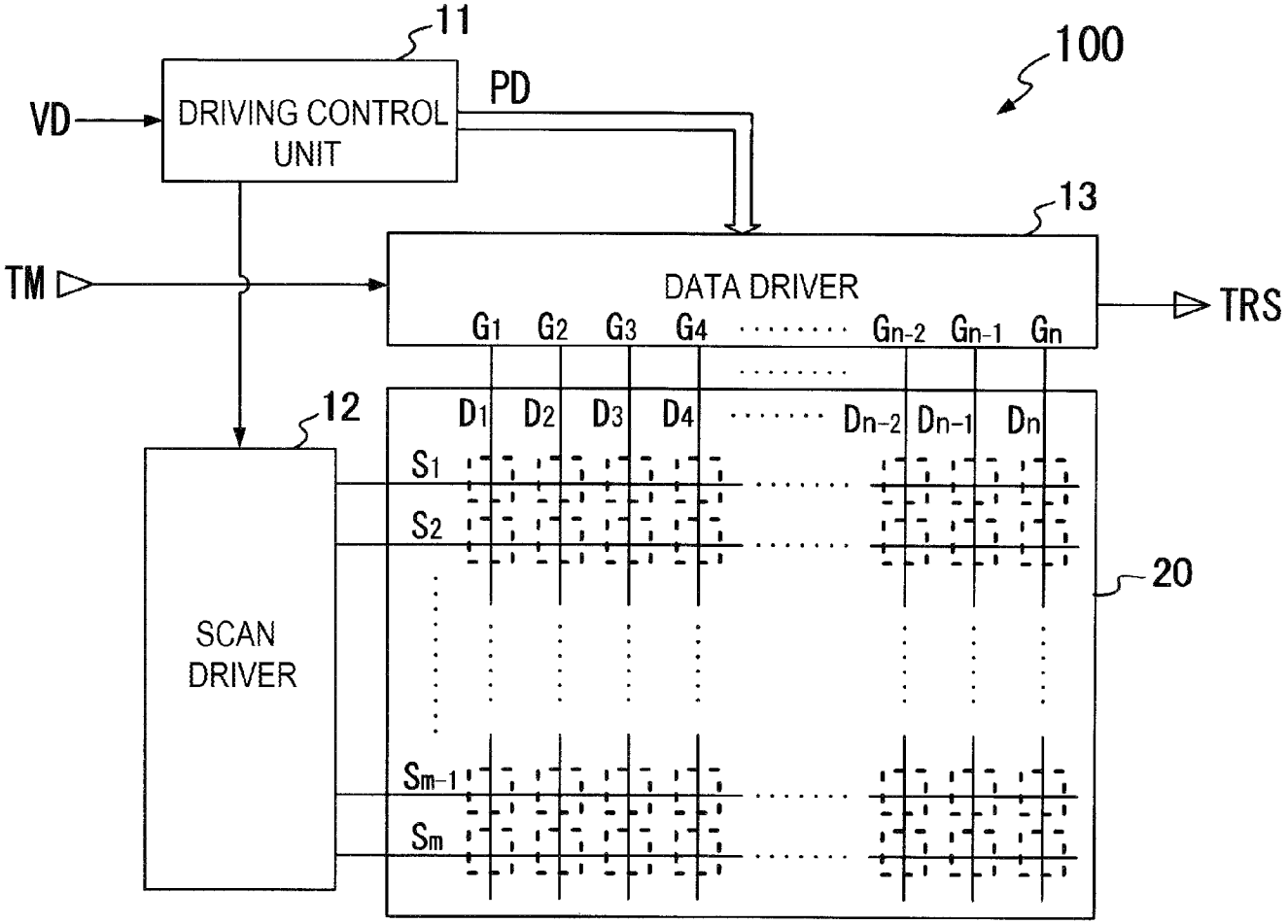
FIG. 1 is a diagram illustrating a schematic structure of a display device that includes a display driver according to an exemplary embodiment.

FIG. 1 is a diagram illustrating a schematic structure for a display device 100 that includes a display driver (data driver) according to an exemplary embodiment. In FIG. 1, a display panel 20 is, for example, a liquid crystal panel or organic EL panel, or the like. In the display panel 20, m horizontal scan lines $S_1$ through $S_m$ (where m is an integer greater than 1) are formed extending in the horizontal direction of a two-dimensional screen, and n data lines $D_1$ through $D_n$ (where n is an integer greater than 1) are formed extending in the vertical direction of the two-dimensional screen. A display cell that constitutes a pixel is formed at each of the intersecting portions between the horizontal scan lines and the data lines. The horizontal scan lines $S_1$ through $S_m$ of the display panel 20 are connected to a scan driver 12, and the data lines $D_1$ through $D_n$ are connected to a data driver 13.

The driving control unit 11 detects a horizontal synchronization signal from the image signal VD and supplies the detected horizontal synchronization signal to the scan driver 12. Moreover, the driving control unit 11, based on the image signal VD, generates a series of pixel data PD having, for example, 8-bit graduation data for specifying the brightness levels of the individual pixels, and supplies the series of pixel data PD to the data driver 13.

The scan driver 12 sequentially applies horizontal scan pulses SP to each of the horizontal scan lines $S_1$ through $S_m$ of the display panel 20, with timing that is synchronized to the horizontal synchronization signal supplied from the driving control unit 11.

The data driver 13 is formed in a semiconductor IC (integrated circuit) chip. In the data driver 13, when a test mode signal TM, supplied from outside of the semiconductor IC chip, indicates a normal mode, the pixel data PD that are supplied from the driving control unit 11 are converted into n pixel drive voltages $G_1$ through $G_n$ that have voltage values corresponding to each of the individual pixel data PD for one horizontal scan line, that is, for n pixels. Given this, the data driver 13 applies the n pixel drive voltages $G_1$ through $G_n$ to the n data lines $D_1$ through $D_n$ of the display panel 20, respectively.

On the other hand, when the test mode signal TM indicates a test mode, the data driver 13 executes a self-diagnostic test (described below), and outputs, to the outside of the display device 100, a test result signal TRS that indicates the test result (either "no-fault" or "fault").

Figure 2:
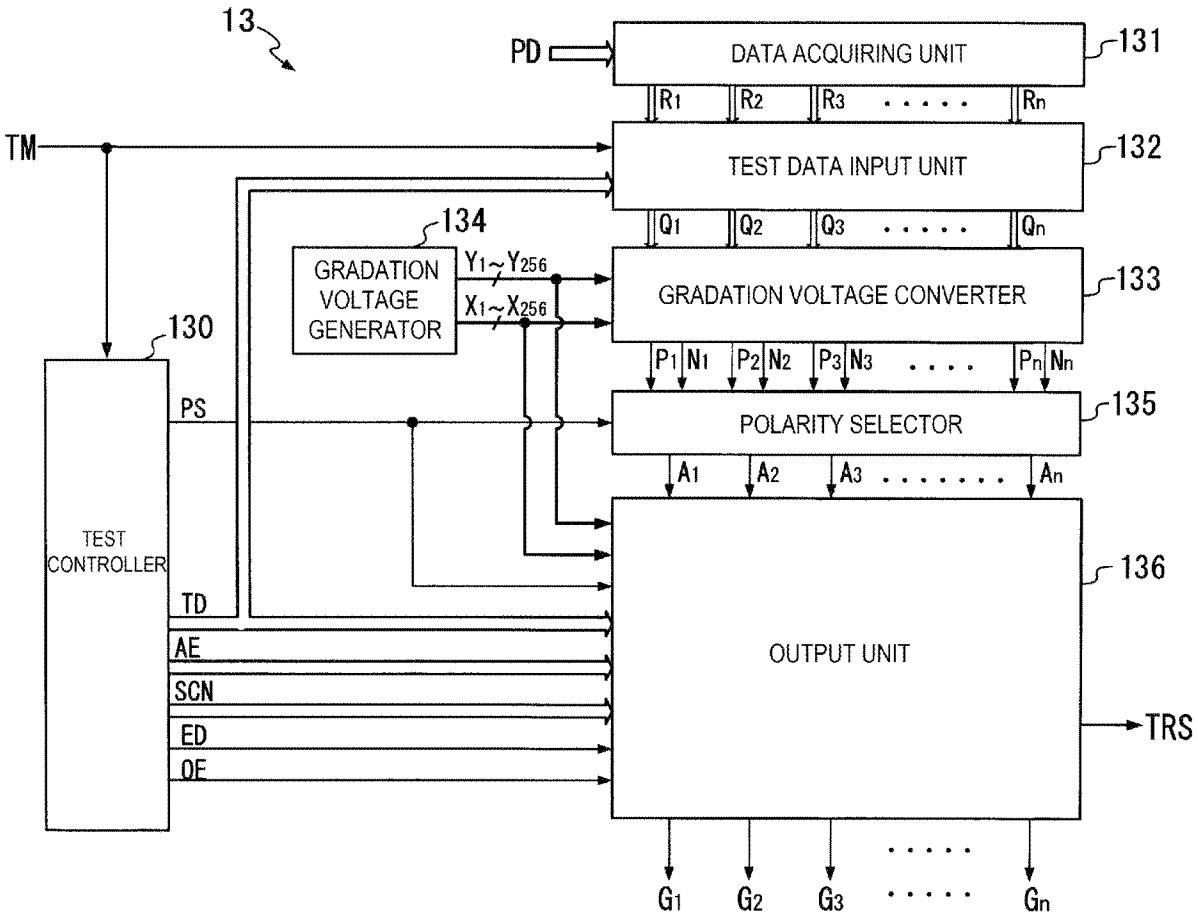
FIG. 2 is a block diagram illustrating the internal structure of a data driver.

FIG. 2 is a block diagram illustrating the internal structure of the data driver 13. The data driver 13 includes n output lines $OL_1$ through $OL_n$ (shown in FIG. 4), a gradation voltage converter 133 as a voltage converter. In FIG. 2, a data acquiring unit 131 sequentially acquires the respective pixel data PD from the driving control unit 11, and, for each set of n pixel data PD for one horizontal scan line, these n pixel data PD are supplied to a test data input unit 132 as pixel data $R_1$ through $R_n$.

If the test mode signal TM indicates the normal mode, the test data input unit 132 supplies the n pieces of pixel data $R_1$ through $R_n$ as-is, as n pieces of pixel data $Q_1$ through $Q_n$, to a gradation voltage converter 133. On the other hand, if the test mode signal TM indicates the test mode, then the test data input unit 132 supplies, to the gradation voltage converter 133, n pieces of pixel data $Q_1$ through $Q_n$ (hereinafter also referred to as "$Q_i$") that indicate the respective values that are indicated by, for example, 8-bit test data TD that are supplied from a test control unit 130.

Figure 3:
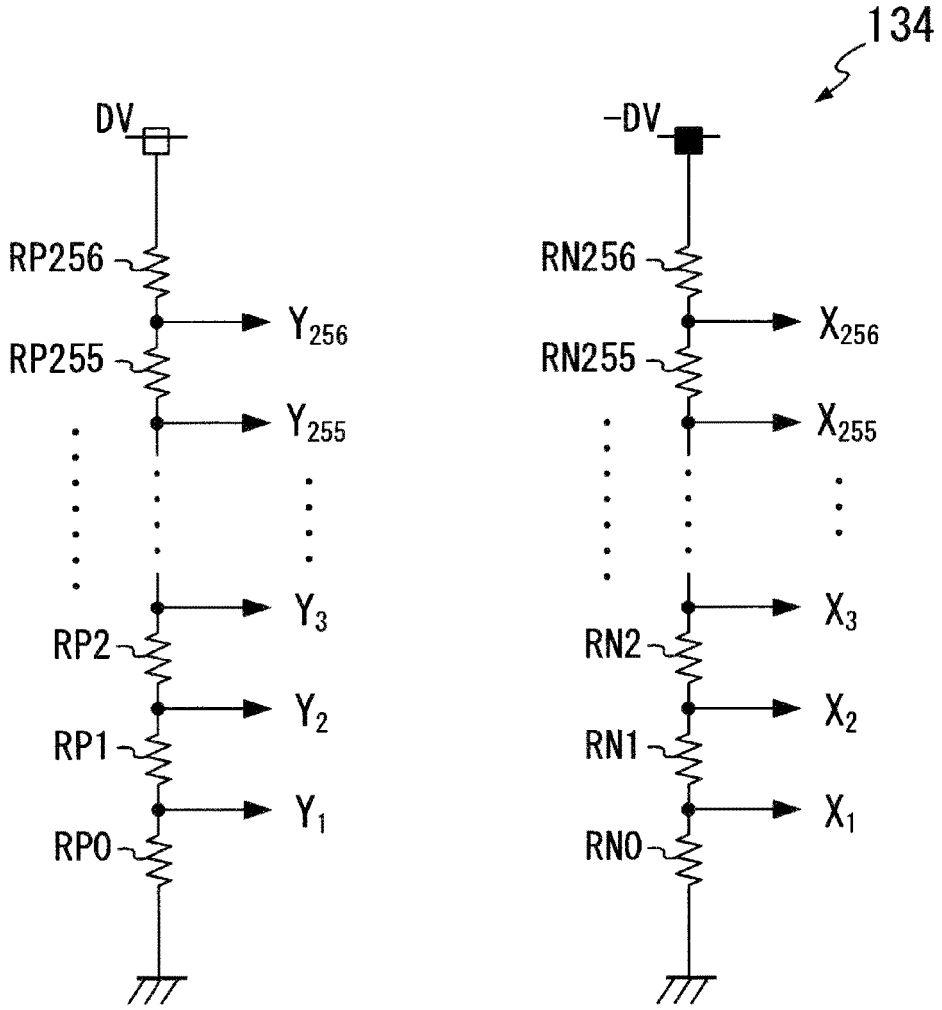
FIG. 3 is a circuit diagram illustrating a ladder resistance included in a gradation voltage generator.

The gradation voltage generator 134 includes, for example, a first ladder resistance having resistances RP0 through RP256, connected in series, and a second ladder resistance having resistances RN0 through RN256, connected in series, as illustrated in FIG. 3. The first ladder resistance generates 256 gradation voltages $Y_1$ through $Y_{256}$ (hereinafter also referred to as "$Y_i$") of positive polarities for the 256 gradations that can be expressed by 8-bit pixel data, based on a positive reference voltage DV. The second ladder resistance generates gradation 256 voltages $X_1$ through $X_{256}$ (hereinafter also referred to as "$X_i$") of negative polarities for the 256 gradations that can be expressed by pixel data of 8-bit, based on a negative reference voltage −DV.

The gradation voltage generator 134 supplies the positive polarity gradation voltages $Y_1$ through $Y_{256}$ and negative polarity gradation voltages $X_1$ through $X_{256}$ to a gradation voltage converter 133.

The gradation voltage converter 133 converts the n pieces of pixel data $Q_1$ through $Q_n$, supplied from the test data input unit 132, into pixel drive voltages $P_1$ through $P_n$ (hereinafter also referred to as "$P_i$") that have positive polarity gradation voltages corresponding to the brightness levels indicated by the pixel data $Q_1$ through $Q_n$ Additionally, the gradation voltage converter 133 converts each of pixel data $Q_1$ through $Q_n$ into n pixel drive voltages $N_1$ through $N_n$ (hereinafter also referred to as "$N_i$"), respectively, each of which has a negative polarity gradation voltage corresponding to the brightness level indicated by the corresponding pixel data $Q_1$ through $Q_n$.

That is, the gradation voltage converter 133, for each pixel data $Q_1$ through $Q_n$, selects, from the positive polarity gradation voltages $Y_1$ through $Y_{256}$ that are supplied from the gradation voltage generator 134, a positive polarity gradation voltage $Y_i$ that corresponds to a gradation of a brightness level indicated by the corresponding pixel data $Q_i$. Given this, the gradation voltage converter 133 outputs each of the gradation voltages Y, selected as described above, for the respective pixel data $Q_1$ through $Q_n$, as positive polarity pixel drive voltages $P_1$ through $P_n$. Moreover, the gradation voltage converter 133, for each pixel data $Q_1$ through $Q_n$, selects, from the negative polarity gradation voltages $X_1$ through $X_{256}$ that are supplied from the gradation voltage generator 134, a negative polarity gradation voltage $X_i$ that corresponds to a gradation of a brightness level indicated by the corresponding pixel data $Q_i$. Given this, the gradation voltage converter 133 outputs each of the gradation voltages $X_i$, selected as described above, for the respective pixel data $Q_1$ through $Q_n$, as negative polarity pixel drive voltages $N_1$ through $N_n$.

The gradation voltage converter 133 supplies, to the polarity selector 135, the positive polarity pixel drive voltages $P_1$ through $P_n$ and the negative polarity pixel drive voltages $N_1$ through $N_n$, described above.

The polarity selector 135 selects alternatingly, with a prescribed period, the positive polarity pixel drive voltages $P_1$ through $P_n$ and the negative polarity pixel drive voltages $N_1$ through $N_n$, and supplies the selected voltages, as pixel drive voltages $A_1$ through $A_n$, to the output unit 136.

However, when a polarity designating signal PS is supplied from the test control unit 130, the polarity selector 135 selects either the positive polarity pixel drive voltages $P_1$ through $P_n$ or the negative polarity pixel drive voltages $N_1$ through $N_n$, corresponding to the polarity designated by the polarity designating signal PS, and supplies them to the output unit 136 as the pixel drive voltages $A_1$ through $A_n$. For example, in response to a polarity designating signal PS of logic level 0, which indicates a positive polarity, the polarity selector 135 selects the positive polarity pixel drive voltages $P_1$ through $P_n$ and supplies them, as the pixel drive voltages $A_1$ through $A_n$, to the output unit 136. On the other hand, in response to a polarity designating signal PS of logic level 1, which indicates a negative polarity, the polarity selector 135 selects the negative polarity pixel drive voltages $N_1$ through $N_n$ and supplies them, as the pixel drive voltages $A_1$ through $A_n$, to the output unit 136.

Figure 4:
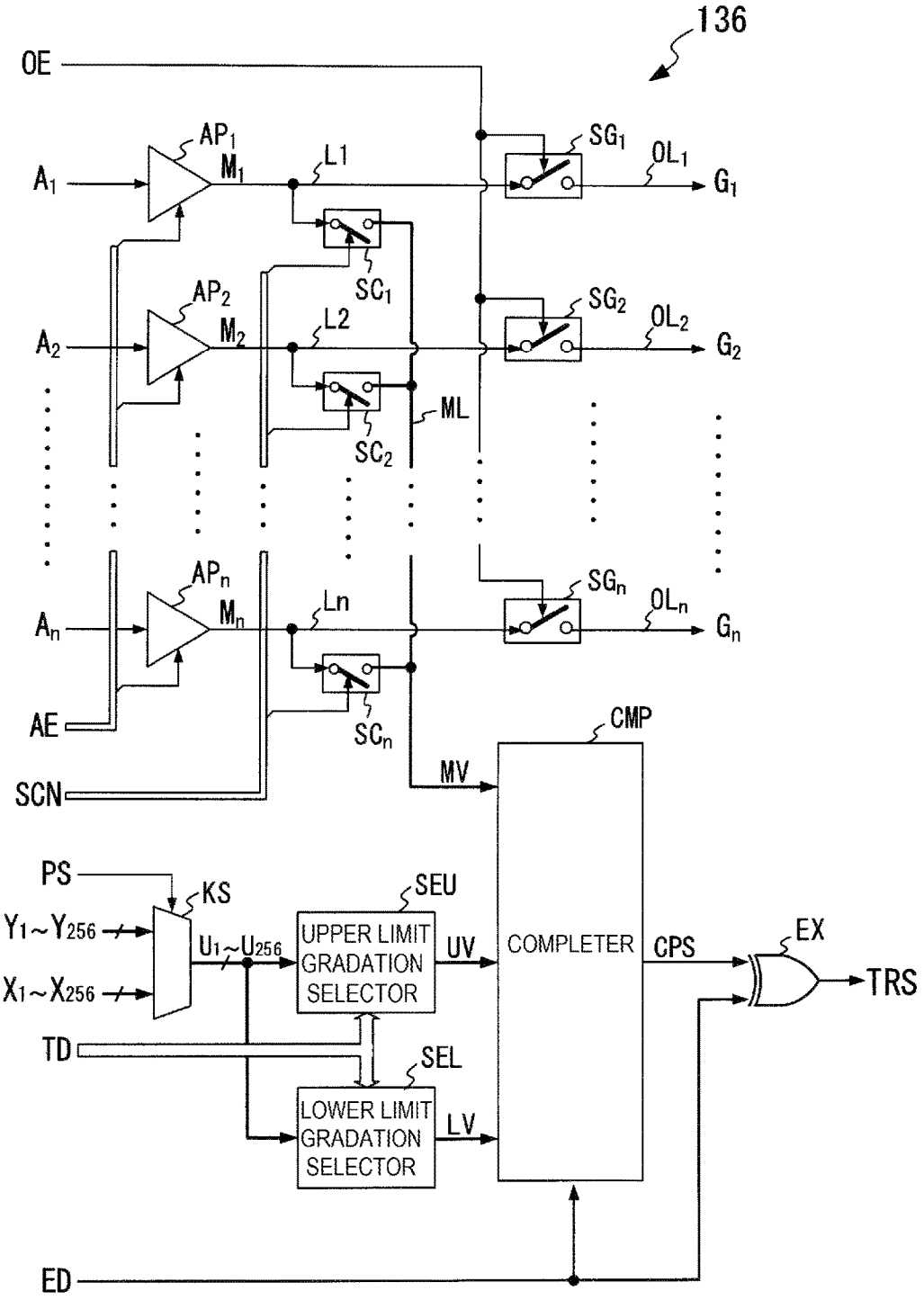
FIG. 4 is a circuit diagram illustrating the internal structure of an output unit.

FIG. 4 is a circuit diagram illustrating the internal structure of the output unit 136. In FIG. 4, amplifiers $AP_1$ through $AP_n$ supply, to the output switches $SG_1$ through $SG_n$, through respective lines $L_1$ through $L_n$, pixel drive voltages $M_1$ through $M_n$ (hereinafter also referred to as "$M_i$") obtained through amplifying the respective pixel drive voltages $A_1$ through $A_n$. Note that the amplifiers $AP_1$ through $AP_n$ are each set individually to either enable or disable the amplifying operations thereof based on amplifier control signals AE supplied from the test control unit 130. At this time, those amplifiers AP, from among the amplifiers $AP_1$ through $AP_n$, that are set to the disabled state have the output terminals thereof set to a high-impedance state.

While the output enable signal OE, which indicates that the outputting is enabled, is supplied from the test control unit 130, the output switches $SG_1$ through $SG_n$ are in the ON state, and the pixel drive voltages $M_1$ through $M_n$ that are supplied from the respective amplifiers $AP_1$ through $AP_n$ are applied to the respective data lines $D_1$ through $D_n$ of the display panel 20 through the output lines $OL_1$ through $OL_n$, as the pixel 001 drive voltages $G_1$ through $G_n$. Note that the output lines $OL_1$ through $OL_n$ are connected to the respective data lines $D_1$ through $D_n$ of the display panel 20.

When the output enable signal OE indicates that output is disabled, the output switches $SG_1$ through $SG_n$ all go into the OFF state, and the electrical connections between the data driver 13 and the display panel 20 are cut off Moreover, in FIG. 4, in addition to output switches $SG_1$ through $SG_n$, described above, scan switches $SC_1$ through $SC_n$ are connected as monitor switches to the respective lines $L_1$ through $L_n$. Note that, as illustrated in FIG. 4, one end each of the respective scan switches $SC_1$ through $SC_n$ is connected to the respective line $L_1$ through $L_n$, and the other end of each scan switch $SC_1$ through $SC_n$ is commonly connected to a monitor line ML.

The scan switches $SC_1$ through $SC_n$ are sequentially set selectively to the ON state based on a scan signal SCN that is sent from the test control unit 130 in response to the test mode signal TM. At this time, of the scan switches $SC_1$ through $SC_n$, the scan switch SC that is set into the ON state supplies, to a comparator CMP, through the monitor line ML, the voltage of the line L that is connected to the end thereof, that is, the voltage value for the pixel drive voltage M that is sent from the amplifier AP that is connected to that line L, as a monitor gradation voltage MV. For example, when the scan switch $SC_1$ is set to the ON state in response to the scan signal SCN, the pixel drive voltage $M_1$ that was sent from the amplifier $AP_1$ is supplied through the scan switch $SC_1$ and the monitor line ML to the comparator CMP, as the monitor gradation voltage MV.

Basically, the respective pixel drive voltages $M_1$ through $M_n$, sent from the respective amplifiers $AP_1$ through $AP_n$, are selectively supplied through the monitor switches ($SC_1$ through $SC_n$), depending on the test mode signal TM, to the monitor line ML.

A gradation polarity selector KS selects either the positive polarity gradation voltages $Y_1$ through $Y_{256}$ or the negative polarity gradation voltages $X_1$ through $X_{256}$, supplied from the gradation voltage generator 134, depending on the polarity designated by the polarity designating signal PS, and supplies these, as gradation voltages $U_1$ through $U_n$, to an upper limit gradation selector SEU and a lower limit gradation selector SEL.

The upper limit gradation selector SEU calculates, as an upper limit gradation value (upper limit graduation voltage), a brightness gradation (brightness voltage) that is one level higher than the brightness gradation indicated by the test data TD, through adding 1 to the test data TD that is supplied from the test control unit 130. Given this, the upper limit gradation selector SEU selects, from the gradation voltages $U_1$ through $U_n$, the gradation voltage corresponding to the upper limit gradation value, and supplies it, as the upper limit gradation voltage UV, to the comparator CMP.

The lower limit gradation selector SEL calculates, as a lower limit gradation value (lower limit gradation voltage), a brightness gradation (brightness voltage) that is one level lower than the brightness gradation indicated by the test data TD, through subtracting 1 to the test data TD that is supplied from the test control unit 130. Given this, the lower limit gradation selector SEL selects, from the gradation voltages $U_1$ through $U_n$, the gradation voltage corresponding to the lower limit gradation value, and supplies it, as the lower limit gradation voltage LV, to the comparator CMP.

The comparator CMP compares the upper limit gradation voltage UV and the lower limit gradation voltage LV, sequentially, to the monitor gradation voltage MV, and supplies, to an exclusive OR gate EX, a comparison result signal CPS that indicates the result of the comparison.

For example, when the expected value data ED, supplied from the test control unit 130, is at logic level 0, the comparator CMP compares the magnitudes of the monitor gradation voltage MV and the upper limit gradation voltage UV, and supplies, to the exclusive OR gate EX, a comparison result signal CPS of logic level 0 if MV is greater than UV, or of logic level 1 if MV is less than UV (an upper limit comparison), as a first comparison result signal. Moreover, when the expected value data ED, is at logic level 1, the comparator CMP compares the magnitudes of the monitor gradation voltage MV and the lower limit gradation voltage LV, and supplies, to the exclusive OR gate EX, a comparison result signal CPS of logic level 1 if MV is greater than LV, or of logic level 0 if MV is less than LV (a lower limit comparison), as a second comparison result signal.

If the logic level of the comparison result signal CPS and the logic level of the expected value data ED are identical, then the exclusive OR gate EX outputs a test result signal TRS of logic level 0 that is a no-fault signal indicates "no-fault." On the other hand, if the logic level of the comparison result signal CPS and the logic level of the expected value data ED are mutually different, then the exclusive OR gate EX outputs a test result signal TRS of logic level 1 that is a fault signal indicates "fault." The exclusive OR gate EX is an example of a logic circuit that outputs a test result signal TRS using the first and second comparison result signals.

Figure 5:
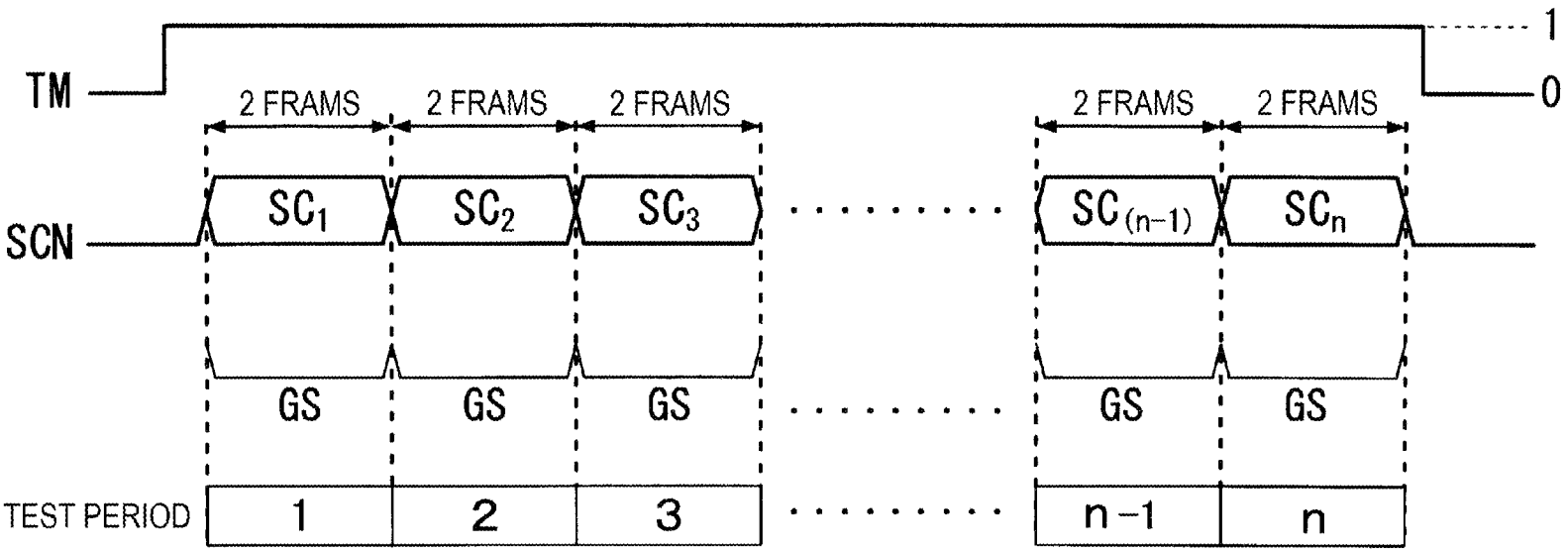
FIG. 5 is a timing chart illustrating a sequence for self-diagnostic testing.

When a test mode signal TM of logic level 1, for example, which indicates the test mode, is supplied from a tester (not shown), connected to the outside of the display device 100, the test control unit 130 executes self-diagnostic testing of a sequence that follows the timing chart shown in FIG. 5. Note that in this self-diagnostic testing, a test is performed as to whether or not an appropriate gradation voltage, corresponding to the respective brightness gradation (for example, between a $1^{st}$ gradation and a $256^{th}$ gradation), is produced by each channel for n systems of circuit networks (hereinafter termed "channels") involved in generating the respective pixel drive voltages $M_1$ through $M_n$, in the gradation voltage converter 133, the polarity selector 135, and the output unit 136.

That is, as illustrated in FIG. 5, the test control unit 130 carries out gradation diagnostic testing GS, for detecting faults in the gradation voltages for each gradation for each channel, in respective $1^{st}$ through $n^{th}$ test periods that comprise the two frames in an image signal. In each of the $1^{st}$ through $n^{th}$ test periods, the test control unit 130 supplies, to the output unit 136, the scan signal SCN that sequentially sets the scan switches $SC_1$ through $SC_n$ of the output unit 136 selectively into the ON state, depending on the test mode signal TM, as illustrated in FIG. 5.

Figure 6:
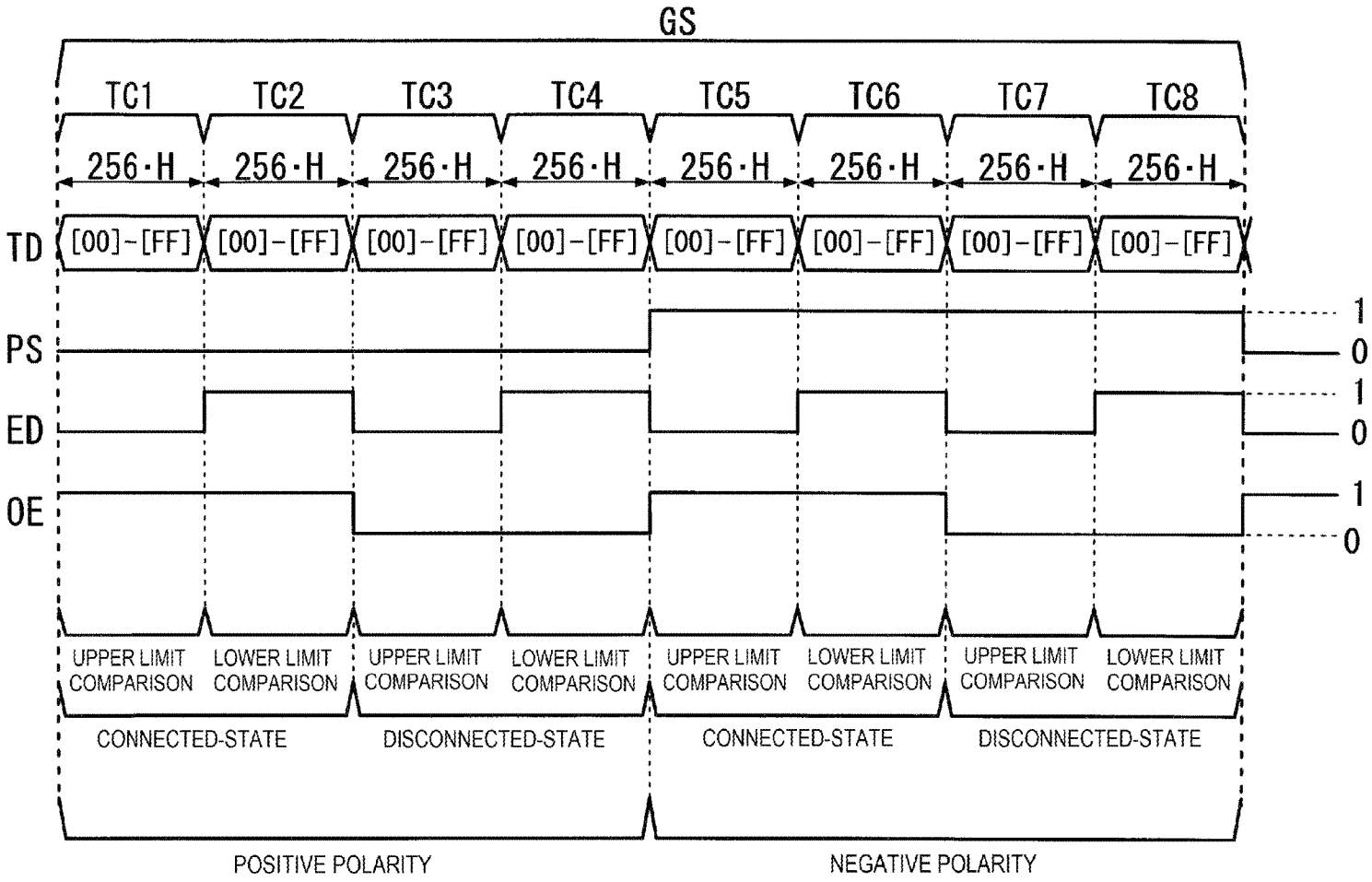
FIG. 6 is a timing chart illustrating a sequence for gradation diagnostic testing GS.

FIG. 6 is a timing chart illustrating the sequence in the gradation diagnostic testing GS. As illustrated in FIG. 6, in the gradation diagnostic testing GS, the test control unit 130 sequentially carries out the individual test steps TC1 through TC8.

The test control unit 130, in each of the individual test steps TC1 through TC4 in the gradation diagnostic testing GS, supplies, to the polarity selector 135 and the output unit 136, a polarity designating signal PS of logic level 0 for designating the positive polarity, and then, in each of test steps TC5 through TC8, supplies, to the polarity selector 135 and the output unit 136, a polarity designating signal PS of logic level 1, designating the negative polarity. The test control unit 130, in the test steps TC1, TC3, TC5, and TC7, supplies expected value data ED of logic valued 0 to the output unit 136, and, in test steps TC2, TC4, TC6, and TC8, supplies expected value data ED of logic level 1 to the output unit 136. Moreover, the test control unit 130, in test steps TC1, TC2, TC5, and TC6, supplies an output enable signal OE of logic level 1, indicating enabled output, to the output unit 136, and, in test steps TC3, TC4, TC7, and TC8, supplies an output enable signal OE of logic level 0, indicating disabled output, to the output unit 136.

Figure 7:
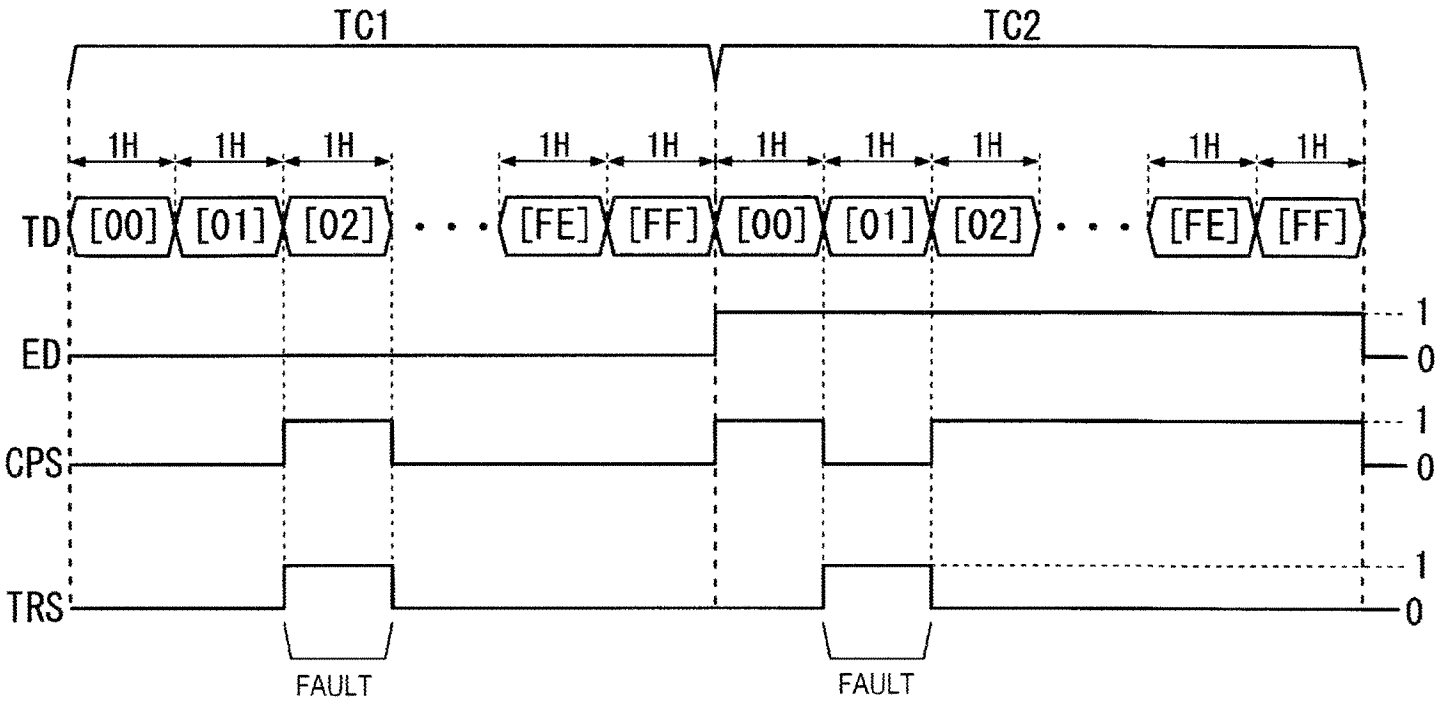
FIG. 7 is a timing chart illustrating examples of comparison result signals in CPSC and test result signals TRS obtained when performing fault detection in testing steps TC1 and TC2.

Moreover, the test control unit 130, in each of test steps TC1 through TC8, generates [00]h through [FF]h, respectively, as test data TD that express, in eight bits, each of the 256 brightness gradations for testing, as illustrated in FIG. 7, in response to the test mode signal TM. The test control unit 130 supplies the [00]h through [FF]h, as test data TD indicating the brightness gradations for testing, sequentially, with each single horizontal scan period H, to the test data input unit 132 and the output unit 136.

Through this, in each of the test steps TC1 through TC8, positive polarity pixel drive voltages $P_i$ and negative polarity pixel drive voltages $N_i$ corresponding to each of the test data [00]h through [FF]h, which express each of the 256 brightness gradations, are outputted from the gradation voltage converter 133. At this time, a series of positive polarity pixel drive voltages $M_i$, each having a respective positive polarity pixel drive voltage $P_i$ that corresponds to a corresponding one of the test data [00]h through [FF]h, are outputted sequentially from the amplifier AP, in response to the polarity designating signal PS for designating positive polarities, in each of the test steps TC1 through TC4. On the other hand, a series of negative polarity pixel drive voltages $M_i$, each having a respective negative polarity pixel drive voltage N that corresponds to a corresponding one of the test data [00]h through [FF]h, are outputted sequentially from the amplifier AP, in response to the polarity designating signal PS for designating negative polarities, in each of the test steps TC5 through TC8

Here, during a first test period, as illustrated in FIG. 5, for example, when the scan switch $SC_1$ is set to the ON state, a series of the positive polarity pixel drive voltage $M_1$ having respective brightness gradation that is sent from the amplifier $AP_1$, in each of the test steps TC1 through TC4, are supplied through the monitor line ML to the comparator CMP as the monitor gradation voltages MV. Moreover, during this first test period, a series of the negative polarity pixel drive voltage $M_1$ having respective brightness gradation that is sent from the amplifier $AP_1$, in each of the test steps TC5 through TC8, are supplied through the monitor line ML to the comparator CMP as the monitor gradation voltages MV.

As illustrated in FIG. 6, the comparator CMP performs the upper limit comparison, described above, for each of the test steps TC1, TC3, TC5, and TC7 wherein the expected value data ED is at logic level 0. That is, for each of the gradations, the comparator CMP compares the magnitude of the monitor gradation voltage MV that corresponds to the brightness gradation to the upper limit gradation voltage UV that expresses the upper limit value for the gradation voltage that is acceptable for that gradation. When, at this time, the upper limit gradation voltage UV is greater than the monitor gradation voltage MV, the comparator CMP supplies, to the exclusive OR gate EX, logic level 0, and, if UV is equal to or less than MV, sends logic level 1, as the comparison result signal CPS. Moreover, as illustrated in FIG. 6, the comparator CMP performs the lower limit comparison, described above, for each of the test steps TC2, TC4, TC6, and TC8 wherein the expected value data ED is at logic level 1. That is, for each of the gradations, the comparator CMP compares the magnitude of the monitor gradation voltage MV that corresponds to the brightness gradation to the lower limit gradation voltage LV that expresses the lower limit value for the gradation voltage that is acceptable for that gradation. When, at this time, the lower limit gradation voltage LV is greater than the monitor gradation voltage MV, the comparator CMP supplies, to the exclusive OR gate EX, logic level 0, and, if LV is equal to or less than MV, sends logic level 1, as the comparison result signal CPS.

That is, when the voltage value of the monitor gradation voltage MV is within the acceptable gradation voltage range, specifically, when within the range from the lower limit gradation voltage LV to the upper limit gradation voltage UV, the comparator CMP outputs a comparison result signal CPS of logic level 0 in test steps TC1, TC3, TC5, and TC7, and of logic level 1 in test steps TC2, TC4, TC6, and TC8. However, if the voltage value of the monitor gradation voltage MV is not a proper value, for example, if the voltage value of the monitor gradation voltage MV is greater than the upper limit gradation voltage UV, then the comparator CMP outputs a comparison result signal CPS of logic level 1 in test step TC1, TC3, TC5, or TC7. Moreover, if the voltage value of the monitor gradation voltage MV is less than the lower limit gradation voltage LV, then the comparator CMP outputs a comparison result signal CPS of logic level 0 in test step TC2, TC4, TC6, or TC8.

Given this, in each of the test steps TC1, TC3, TC5, and TC7 wherein the upper limit comparison is performed, the test control unit 130 supplies, to the exclusive OR gate EX, an expected value data ED having logic level 0 as the expected value. Moreover, in each of the test steps TC2, TC4, TC6, and TC8 wherein the lower limit comparison is performed, the test control unit 130 supplies, to the exclusive OR gate EX, an expected value data ED having logic level 1.

Given this, as illustrated in FIG. 7, for example, when, in test step TC1, a comparison result signal CPS of logic level 1 is received, or when, in test step TC2, a comparison result signal CPS of logic level 0 is received, then a test result signal TRS of logic level 1, indicating "fault" is outputted to the outside. On the other hand, if the voltage value for the monitor gradation voltage MV is within the acceptable gradation voltage range (between LV and UV), then, in each of test steps TC1 through TC8, a test result signal TRS of logic level 0, indicating "no-fault" is outputted to the outside.

That is, the fault evaluating unit that includes the comparator CMP and the exclusive OR gate EX evaluates whether or not the voltage value on the monitor line ML is within the acceptable gradation voltage range (between LV and UV), and if within that range, outputs, to the outside, a test result signal TRS indicating that there is no-fault, and if not in that range, outputs a test result signal TRS indicating a fault.

Here the tester that is connected outside of the data driver 13 reads in the test result signal TRS, and detects those test periods, from among the 1st through nth test periods shown in FIG. 5, wherein the test result signal TRS of logic level 1 have been read in, indicating a fault. That is, the tester, through counting the position, from the beginning of the test, of the test period in which a fault occurs, specifies the channel wherein the test result signal TRS of logic level 1, which indicates a fault, is acquired.

For example, because, of the scan switches SC1 through SCn illustrated in FIG. 4, during the first test period, only $SC_1$ is in the ON state, the first channel, which generates the pixel drive voltages $M_1$, is the subject of the fault diagnostic testing. Accordingly, if, during the first test period, even a single test result signal TRS of logic level 1, which indicates "fault" is read in, the tester determines that there is a fault in the first channel. On the other hand, if the test result signal TRS remains in the logic level 0 state, which indicates "no-fault," across the entirety of the first test period, then the tester determines that there is no-fault in the first channel.

Moreover, for example, in the $n^{th}$ test period, of the scan switches $SC_1$ through $SC_n$, only $SC_n$ will be in the ON state, and thus the $n^{th}$ channel, for generating the pixel driving voltages $M_n$, will be the subject of fault diagnostics. If, through this, a test result signal TRS of logic level 1, which indicates a fault, is received even once during the $n^{th}$ test period, the tester concludes that there is a fault in the $n^{th}$ channel, but if the test result signal TRS remains in the logic level 0 state, which indicates "no fault," is maintained over the entirety of the nth test period, then the determination will be that there is no fault in the nth channel.

Note that in test steps TC1 through TC4, as illustrated in FIG. 6, the test control unit 130 supplies, to the polarity selector 135 and the output unit 136 of a gradation polarity selector KS, a polarity designating signal PS that indicates the positive polarity. Through this, in each of test steps TC1 through TC4, the test control unit 130 carries out self-diagnostic testing for testing the various positive polarity gradation voltages (positive polarity tests). On the other hand, in each of test steps TC5 through TC8, the test control unit 130 carries out self-diagnostic testing for testing the various negative polarity gradation voltages (negative polarity tests) through supplying the polarity designating signal PS that indicates the negative polarity to the polarity selector 135 and a gradation polarity selector KS of the output unit 136.

Moreover, in each of the test steps TC1, TC2, TC5, and TC6, as illustrated in FIG. 6, the test control unit 130 supplies an output enable signal OE with logic level 1, which indicates enabled output, to the output switches $SG_1$ through $SG_n$. Through this, in each of the test steps TC1, TC2, TC5, and TC6, a state is produced wherein the display panel 20 is connected electrically to the data driver 13, where the self-diagnostic testing described above is carried out by the test control unit 130 in this state (hereinafter termed the "connected-state testing").

On the other hand, in each of the test steps TC3, TC4, TC7, and TC8, as illustrated in FIG. 6, the test control unit 130 supplies an output enable signal OE with logic level 0, which indicates disabled output, to the output switches $SG_1$ through $SG_n$. Through this, in each of the test steps TC3, TC4, TC7, and TC8, a state is produced wherein the display panel 20 is disconnected electrically from the data driver 13, where the self-diagnostic testing described above is carried out by the test control unit 130 in this state (hereinafter termed the "disconnected-state testing").

At this time, the tester produces the diagnostic results illustrated in FIG. 8, based on the details of the test results indicated by a test result signal TRS in the disconnected-state testing, and the details of a test result in the connected-state testing, described above.

That is, as illustrated in FIG. 8, if the test result signals TRS obtained in both the connected-state testing and the disconnected-state testing are "no-fault," then it is determined that there is no-fault in either the data driver 13 or the display panel 20.

Moreover, if, as illustrated in FIG. 8, the test result signal TRS obtained in the connected-state testing indicates a "fault" and the test result signal TRS obtained in the disconnected-state testing indicates "no-fault," then the tester determines that there is no-fault in the data driver 13 and that there is a fault in the display panel 20.

Moreover, as illustrated in FIG. 8, if the test result signals TRS obtained in both the connected-state testing and the disconnected-state testing are "fault," then it is determined that there is fault in at least the data driver 13, from among the data driver 13 or the display panel 20.

As described above, the data driver 13 tests each channel as to whether or not the appropriate gradation voltages, corresponding to the respective brightness gradations, have been generated in response to the test mode signal TM that is supplied from the outside (self-diagnostic testing), and outputs, to the outside, a test result signal TRS indicating the test results.

Moreover, in this fault-diagnostic testing, the output switches $SG_1$ through $SG_n$, illustrated in FIG. 4, are switched between the ON and OFF states, to perform the connected-state testing, where the display panel 20 is connected electrically to the data driver 13, and the disconnected-state testing, wherein the electrical connections between the display panel 20 and the data driver 13 are disconnected.

That is, the test control unit 130 performs connected-state testing wherein the test data TD that indicate the various brightness gradations for testing are supplied to the gradation voltage converter 133 in a state wherein the output switches $SG_1$ through $SG_n$ are set to the ON state, in response to the test mode signal TM, and carries out disconnected-state testing wherein the test data TD are supplied to the gradation voltage converter 133 in a state wherein the output switches $SG_1$ through $SG_n$ are set to the OFF state.

Through this, the tester is able to perform diagnostics individually for faults that occur in the data driver 13 and faults that occur in the display panel 20, as illustrated in FIG. 8, based on the respective testi results (TRS) for the connected-state testing and the disconnected-state testing, without removing the display panel 20 from the data driver 13.

Note that in the comparator CMP, the upper limit comparisons for comparing the magnitudes of the monitor gradation voltages MV and the upper limit gradation voltages UV to each other, and the lower limit comparisons for comparing the magnitudes of the monitor gradation voltages MV and the lower limit gradation voltages LV to each other may be performed through time-division, as illustrated in FIG. 6, or the upper limit comparisons and the lower limit comparisons may be carried out simultaneously through the use of two independent comparators.

Figure 9:
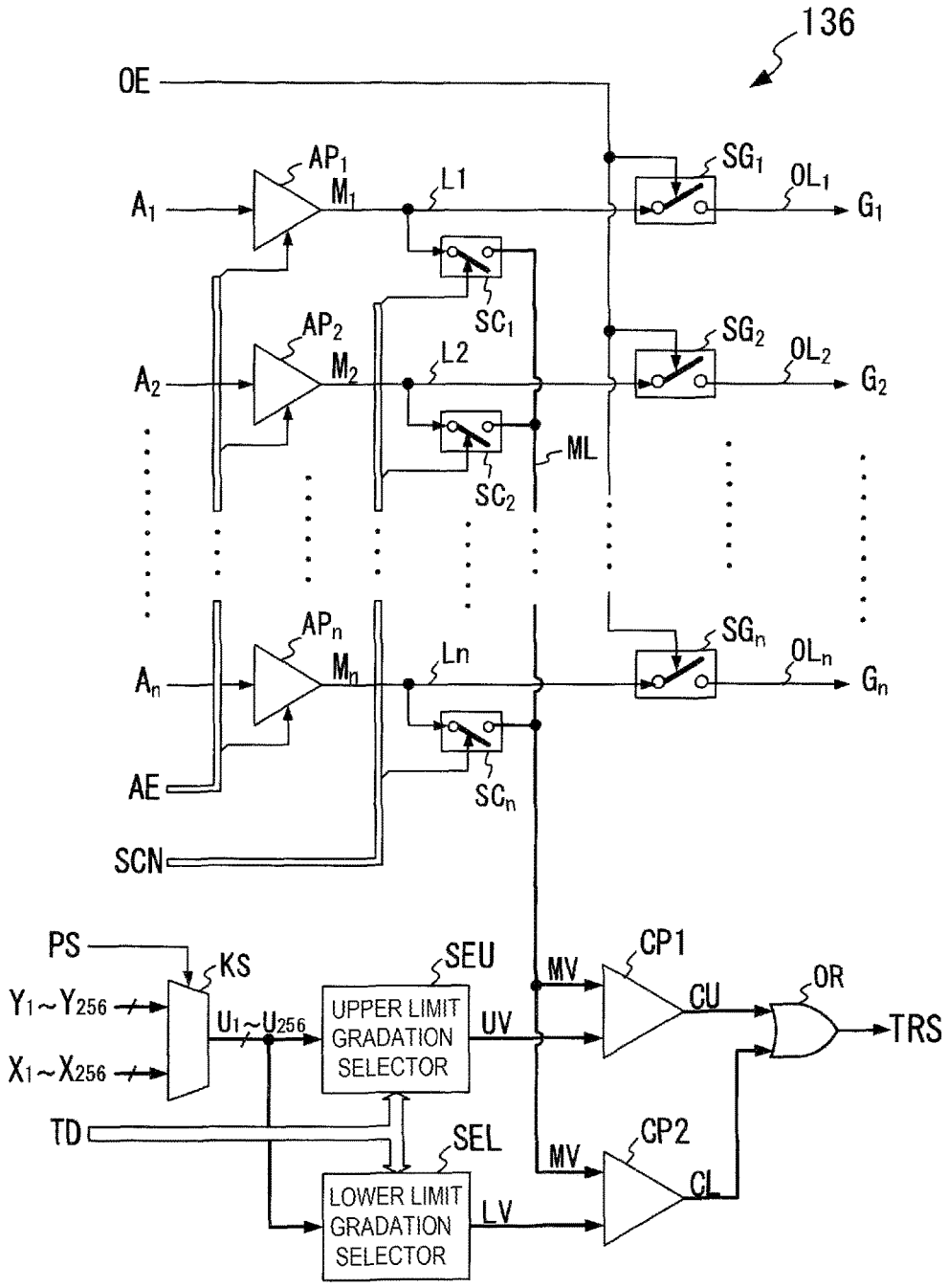
FIG. 9 is a circuit diagram illustrating another example of the internal structure of the output unit.

FIG. 9 is a circuit diagram illustrating another structure for the output unit 136, produced in contemplation of this point.

Note that in the structure illustrated in FIG. 9, comparators $CP_1$ and $CP_2$ are used instead of the comparator CMP that is illustrated in FIG. 4, where the other structures, aside from the point that an OR gate OR is used instead of the exclusive OR gate EX, are identical to those shown in FIG. 4.

In FIG. 9, the comparator $CP_1$ carries out comparisons to evaluate whether or not the monitor gradation voltages MV are less than the upper limit gradation voltages UV supplied from the upper limit gradation selector SEU. If here the monitor gradation voltage MV is less than the upper limit gradation voltage UV, the comparator $CP_1$ supplies, to the OR gate OR, a comparison result signal CU of logic level 0, indicating that there is no-fault. On the other hand, if the monitor gradation voltage MV is not less than the upper limit gradation voltage UV, then the comparator $CP_1$ supplies, to the OR gate OR, a comparison result signal CU of logic level 1, indicating a fault.

The comparator $CP_2$ carries out comparisons to evaluate whether or not the monitor gradation voltages MV are greater than the lower limit gradation voltages LV supplied from the lower limit gradation selector SEL. If here the monitor gradation voltage MV is greater than the lower limit gradation voltage LV, the comparator $CP_2$ supplies, to the OR gate OR, a comparison result signal CL of logic level 0, indicating that there is no-fault. On the other hand, if the monitor gradation voltage MV is less than the lower limit gradation voltage LV, then the comparator CP2 supplies, to the OR gate OR, a comparison result signal CL of logic level 1, indicating a fault.

The OR gate OR outputs, to the outside, a test result signal TRS of logic level 0, indicating that there is no-fault if there is no-fault in either the comparison result signal CU or CL. If there is a fault in either the comparison result signal CU or CL, then the OR gate OR outputs, to the outside, a test result signal TRS of logic level 1, indicating that there is a fault.

Through this, when the structure illustrated in FIG. 9 is used, the expected value data ED are not necessary. Moreover, the ability to carry out simultaneously those upper limit comparisons and lower limit comparisons that were carried out sequentially through time division in the gradation diagnostic testing GS shown in FIG. 6, this enables the time required for the gradation diagnostic testing GS to be cut in half.

Moreover, while in the embodiments described above, the operations were explained with 256 brightness gradations indicated by the pixel data, the brightnesses are not limited to 256 gradations. Fundamentally, in the gradation voltage generator 134, positive polarity gradation voltages $Y_1$ through $Y_k$ and negative polarity gradation voltages $X_1$ through $X_k$ may be generated corresponding to 1st through kth brightness gradations (where k is an integer greater than 1), and the test control unit 130 may generate a series of test data, as test data TD, indicating first kth case brightness gradations for testing.

Fundamentally, in the data driver 13, 1st through nth pixel drive voltages ($M_1$ through $M_n$ (where n is an integer greater than 1), generated by the voltage converter (133 or 134) based on test data that indicate the brightness gradations for testing, are supplied to the monitor line (ML) selectively through the monitor switches ($SC_1$ through $SC_n$). The fault evaluating unit (CMP, EX, $CP_1$, $CP_2$, OR) evaluates whether or not the voltage value on the monitor line is within an acceptable gradation voltage range, and outputs, to the outside, a test result signal (TRS) indicating that there is no-fault if within the acceptable gradation voltage range, and indicating that there is a fault if not within the acceptable gradation voltage range. Here the test control unit (130), in response to a test mode signal (TM), carries out connected-state testing, wherein the test data is supplied to the voltage converter in a state wherein output switches ($SG_1$ through $SG_n$), for sending 1st through nth pixel drive voltages to a display panel (20) are set to the ON state, and disconnected-state testing, wherein the test data is supplied to the voltage converter in a state wherein the output switches are set to the OFF state.

What is claimed is:

1. A display driver for driving a display panel having a plurality of data lines in which a plurality of pixels are arranged, the display driver comprising:

n output lines each of which is connected to at least one of the plurality of data lines, n being an integer greater than 1;

a data acquiring unit acquiring n pixel data from a driving control unit, each of the n pixel data designating a brightness gradation for each pixel formed on a corresponding one of the plurality of data lines, respectively;

a test control circuit configured to generate n test data each of which designates a brightness gradation for each pixel formed on a corresponding one of the plurality of data lines, respectively, and control a connected-state test for testing the display panel and a disconnected-state test for testing the display driver, the connected-state test being performed in a connected-state where the display panel and the display driver are electrically connected, the disconnected-state test being performed in a disconnected-state where the display panel and the display driver are electrically disconnected;

a test data input circuit connected to each of the test control circuit and the data acquiring unit and configured to receive as inputs the n test data from the test control circuit and the n pixel data from the data acquiring unit, and to select one of the n test data and the n pixel data to output as output data, the test data input circuit selecting the n test data when a test mode signal is received indicating a test mode, and the test data input circuit selecting the n pixel data when the test mode signal indicates a normal mode;

a voltage converter configured to generate n pixel drive voltages for driving each pixel from one of the n test data and the n pixel data;

an output circuit configured to supply each of the n pixel drive voltages to a corresponding one of the plurality of the data lines in the connected-state; and a fault evaluation circuit configured to output a test result signal including a fault signal or a no-fault signal by checking a value of each of the n pixel drive voltages in both of the connected-state and the disconnected-state, the fault signal indicating at least one of the n pixel drive voltages being outside of an acceptable gradation voltage range in either the connected-state or the disconnected-state, the no-fault signal indicating each of the n pixel drive voltages being within the acceptable gradation voltage range in both of the connected-state and the disconnected-state.

2. The display driver according to claim 1, further comprising:

a monitor line connected to the fault evaluation circuit; and n test switches connected between the voltage converter and the monitor line and configured to connect the voltage converter to the monitor line so that the n pixel drive voltages are supplied to the fault evaluation circuit.

3. The display driver according to claim 2, further comprising n output switches connected between the voltage converter and the n output lines and configured to connect the display driver to the display panel in the connected-state so that each of the n pixel drive voltages is supplied to the corresponding one of the plurality of data lines of the display panel.

4. The display driver according to claim 3, wherein the test control circuit generates, in response to reception of the test mode signal sent from outside of the display driver, a test switch enable signal for selectively turning each of the n test switches ON in the connected-state and the disconnected-state, and an output switch enable signal for turning each of the n output switches ON in the connected-state.

5. The display driver according to claim 1, wherein the voltage converter selects, from k gradation voltages, n gradation voltages each of which is designated by the corresponding one of the n test data, and outputs the selected n gradation voltages as the n pixel drive voltages in the connected-state and the disconnected-state.

6. The display driver according to claim 5, wherein the acceptable gradation voltage range is set to each of the n test data and includes a lower limit and an upper limit, each lower limit corresponds to a gradation voltage one voltage level lower than the gradation voltage designated by a corresponding one of the n test data, and each upper limit corresponds to a gradation voltage one voltage level higher than the gradation voltage designated by a corresponding one of the n test data.

7. The display driver according to claim 6, further comprising:

a lower limit selector is-configured to select, from the k gradation voltages, the gradation voltage one voltage level lower than the gradation voltage designated by the corresponding one of the n test data as said lower limit; and an upper limit selector configured to select, from the k gradation voltages, the gradation voltage one voltage level higher than the gradation voltage designated by the corresponding one of the n test data as said upper limit .

8. The display driver according to claim 5, wherein the fault evaluation circuit includes:

a first comparator which compares each of the n pixel drive voltages with a corresponding upper limit and outputs a first comparison result signal indicating no-fault in response to each of the n pixel drive voltages being lower than the corresponding upper limit, a second comparator which compares each of the n pixel drive voltages with a corresponding lower limit and outputs a second comparison result signal indicating no-fault in response to each of the n pixel drive voltages being greater than the corresponding lower limit, and a logic circuit which outputs the test result signal indicating no-fault when the first and second comparison result signals both indicate no-fault, and fault when at least one of the first and second comparison result signals do not indicate no-fault.

9. The display driver according to claim 1, further comprising a gradation voltage generation circuit configured to generate k positive polarity gradation voltages each having a different positive polarity voltage level, the positive polarity gradation voltages respectively corresponding to one of k positive polarity brightness gradations, and k negative polarity gradation voltages each having a different negative polarity voltage level, the negative polarity gradation voltages respectively corresponding to one of k negative polarity brightness gradations, k being an integer greater than 1, wherein the display driver further comprises a polarity selector configured to select, in response to a positive polarity selection signal for selecting a positive polarity, the n pixel drive voltages having the positive polarity, and in response to a negative polarity selection signal for selecting a negative polarity, the n pixel drive voltages having the negative polarity, wherein the voltage converter selects, from the k positive polarity gradation voltages, n positive polarity gradation voltages each of which is designated by a corresponding one of the n test data, selects, from the k negative polarity gradation voltages, n negative polarity gradation voltages each of which is designated by the corresponding one of the n test data, and outputs the selected n positive polarity gradation voltages and the selected n negative polarity gradation voltages to the polarity selector to select one of the selected n positive polarity gradation voltages and the selected n negative polarity gradation voltages as the n pixel drive voltages, and the test control circuit generates the positive polarity selection signal in a positive polarity term and the negative polarity selection signal in a negative polarity term, the connected-state test and the disconnected-state test being performed in a connected-state test term and in a disconnected-state test term, respectively, each having the positive polarity term and the negative polarity term.

10. The display driver according to claim 9, wherein the acceptable gradation voltage range is set to each of the n test data and includes a lower limit and an upper limit, each lower limit corresponds to a gradation voltage one voltage level lower than the gradation voltage designated by the corresponding one of the n test data, and each upper limit corresponds to a gradation voltage one voltage level higher than the gradation voltage designated by the corresponding one of the n test data.

11. The display driver according to claim 10, further comprising a lower limit selector configured to select, from the k gradation voltages, the gradation voltage one voltage level lower than the gradation voltage designated by the corresponding one of the n test data as said lower limit; and an upper limit selector configured to select, from the k gradation voltages, the gradation voltage one voltage level higher than the gradation voltage designated by the corresponding one of the n test data as said upper limit.

12. The display driver according to claim 9, wherein the fault evaluation circuit includes:

a first comparator which compares each of the n pixel drive voltages with a corresponding upper limit and outputs a first comparison result signal indicating no-fault in response to each of the n pixel drive voltages being lower than the corresponding upper limit, a second comparator which compares each of the n pixel drive voltages with a corresponding lower limit and outputs a second comparison result signal indicating no-fault in response to each of the n pixel drive voltages being greater than the corresponding lower limit, and a logic circuit which outputs the test result signal indicating no-fault when the first and second comparison result signals both indicate no-fault, and fault when at least one of the first and second comparison result signals indicates fault.

13. The display driver according to claim 1, wherein the plurality of data lines of the display panel includes n data lines each of which is electrically connected to one of the n output lines in the connected-state, respectively.

14. The display driver according to claim 1, wherein the fault evaluation circuit switches between comparing each pixel drive voltage to the upper limit voltage and the lower limit voltage according to an expected-data control signal generated by the test control circuit, such that the fault signal and the no-fault signal are generated based on both the comparison result signal and the expected-data control signal.

15. A method for evaluating a display device that includes a display panel having a plurality of data lines in which a plurality of pixels are arranged, and a display driver for driving the display panel, the method comprising:

generating n test data each of which designates a brightness gradation for each pixel formed on a corresponding one of the plurality of data lines, n being an integer greater than 1;

receiving, by a test data input unit, the n test data as inputs;

receiving, by the test data input unit, n pixel data as inputs, wherein each of the n pixel data designates a brightness gradation for each pixel formed on a corresponding one of the plurality of data lines, respectively;

selecting, by the test data input unit, one of the n test data and the n pixel data based on a test mode signal indicating one of a test mode and a normal mode;

generating n pixel drive voltages for driving each pixel from the n test data in a connected-state where the display panel and the display driver are electrically connected and in a disconnected-state where the display panel and the display driver are electrically disconnected;

supplying each of the n pixel drive voltages to a corresponding one of the plurality of the data lines for testing the display panel in the connected-state;

checking whether each of the n pixel drive voltages is within an acceptable gradation voltage range in both of the connected-state and in the disconnected-state; and outputting a test result signal including a fault signal or a no-fault signal, the fault signal indicating at least one of the n pixel drive voltages being outside of the acceptable gradation voltage range in either the connected-state or the disconnected-state, the no-fault signal indicating each of the n pixel drive voltages being within an acceptable gradation voltage range in both of the connected-state and the disconnected-state.

* * * * *